US005579692A

United States Patent [19]

Collier

[11] Patent Number: 5,579,692

[45] Date of Patent: Dec. 3, 1996

[54] SPECIAL EFFECTS RUBBER STAMP HAVING INTERCHANGEABLE IMAGES

[76] Inventor: Harry B. Collier, 2851 E. Wyecliff Way, Highlands Ranch, Colo. 80126

[21] Appl. No.: 374,924

[22] Filed: Jan. 18, 1995

Related U.S. Application Data

[63] Continuation-in-part of Ser. No. 977,225, Nov. 16, 1992, Pat. No. 5,410,962, which is a continuation-in-part of Ser. No. 701,486, May 16, 1991, Pat. No. 5,178,067.

[51] Int. Cl.[6] ..... B41K 1/56

[52] U.S. Cl. ..... 101/405; 101/368

[58] Field of Search ..... 101/405, 406, 101/368, 372, 494; 401/195; 446/397, 485; 40/452, 455

[56] References Cited

U.S. PATENT DOCUMENTS

| | | | |
|---|---|---|---|
| 2,899,895 | 8/1959 | Tannery | 101/405 |
| 3,158,096 | 11/1964 | Arnold | 101/405 |
| 4,924,773 | 5/1990 | Gwilliam | 101/405 |
| 5,049,107 | 9/1991 | De Nittis | 446/397 |
| 5,178,067 | 1/1993 | Collier | 101/405 |

*Primary Examiner*—Edgar S. Burr
*Assistant Examiner*—Anthony H. Nguyen

[57] ABSTRACT

A rubber stamp is disclosed which produces a special effect when the stamp is pressed against a medium to be imprinted therewith. The stamp is comprised of a handle and a plurality of die mounts with images thereon which are interchangeable upon the handle. The special effect which is generated by operation of the rubber stamp is determined by the image mounted thereon. A plurality of special effects are provided within the rubber stamp which correlate with a plurality of images attachable thereto. The special effects generated by the stamp can include audible (sounds and/or voice and/or music), light (patterns and/or sequences), and/or aromas. A cavity in the plastic handle of the rubber stamp contains the electronic circuitry necessary to provide the special effects messages. Sensors, such as an array of pressure sensitive switches, are affixed within the plastic handle so as to engage in a predetermined manner with an actuator in the attached die mount upon imprinting, so as to trigger the electronic circuitry to issue a respective special effects message simultaneously with imprinting of a visual image from the rubber stamp upon the desired medium. A large variety of operative alternatives are disclosed, including effects generation asynchronous with imprinting the rubber stamp. Application to rotating rubber stamps and to other hand-held image generation devices are also disclosed.

31 Claims, 9 Drawing Sheets

SPECIAL EFFECTS RUBBER STAMP HAVING INTERCHANGEABLE IMAGES

This application is a Continuation-In-Part of application Ser. No. 07/977,225, filed Nov. 16, 1992, now U.S. Pat. No. 5,410,962, which is a Continuation-In-Part of application Ser. No. 07/701,486, filed May 16, 1991, now U.S. Pat. No. 5,178,067.

BACKGROUND OF THE INVENTION

1. Field of the Invention

The present invention relates to rubber stamps and, more particularly, to rubber stamps capable of producing special effects such as those producing sound, light and other special effects.

2. Statement of the Problem

Rubber stamps have been conventionally used for a long period of time to transfer an ink message onto paper sheets. A wide variety of rubber stamps are available which transfer ink images of animals, greetings, business information, or other types of images. Rubber stamps are normally hand-held devices, composed of an image transfer portion, known as the die or as the stamp element, permanently affixed in various manners to a handle portion, and utilized for transferring a predetermined ink message to a flat medium or target object, i.e. paper, which can receive and retain the printed message. The image to be printed is typically permanently molded into the die. The die is said to be "mounted" to the handle when it is affixed thereto. In the traditional rubber stamp industry the entire handle is often known as the "mount". Herein, however, the part of the rubber stamp device upon which the die is mounted may be distinguished from the part by which the device is held, as discussed elsewhere herein. The area of the rubber stamp device to which the die is mounted is typically a flat, rigid surface slightly larger in area dimensions than the stamp element mounted thereon. The image transfer process of ink stamping is an inexact printing process. Due to variations in the manufacturing of the die, the ink deposition and materials which are imprinted therewith, the die is often mounted upon a dense foam pad which is itself mounted upon the stamp handle. The pad allows the die to flexibly conform to mismatches in transfer surfaces.

The Applicant in U.S. Pat. No. 5,178,067 has addressed the need to provide special effects to a conventional rubber stamp. Such effects include, for example, audible messages such as sound or music, visual messages such as different colored lights or sequences of light patterns, aromas, or combinations of such effects. The novel combination of a traditional rubber stamp with a mechanism to generate special effects during the use of that stamp has created value to the consumer and resulted in the emergence of a substantial market for such devices.

However, the addition of sound generating and switching mechanisms increases the manufacturing cost and cost to the consumer of the effects rubber stamp over that of a traditional rubber stamp of comparable size and quality. Additionally, each effects stamp only provides a single image with the effects message(s) and; therefore, children can become bored and, as with a single die traditional stamps, play value is limited.

A need exists to provide more economic value to the consumer through reduction in the cost per message (imprinted and effects) and to increase the play value of the effects stamp.

The Applicant has developed approaches to increasing the image variety and play value of effects stamps to the consumer in his invention of the Rubber Stamp Activity Set Having Special Effects, which is specified in the Applicant's pending application Ser. No. 07/912,480. The cost per message is also much lower in a special effects stamp activity set than it is in the single effects stamp, however, the total cost of such an activity set is much greater than that of a single special effects rubber stamp device.

The Applicant has further addressed the need for more variety and play value at a reduced per message cost in his invention specified in pending application, Ser. No. 07/977,225, Special Effects Rotating Rubber Stamp. In this invention the Applicant has provided special effects to rolling rubber stamps and rotating type rubber stamps which have a plurality of stamp elements. A rotating, multiple image effects stamp of this invention does achieve an increase in play value and a decrease in cost per message for the consumer compared to a single die effects stamp of the above mentioned patent. The increased economy is due to the use of a single sound chip circuit for multiple sounds and a single handle for multiple die. However, in the Applicant's rotating, multiple image effects stamp there exists a trade-off between the extra expense of a handle mechanism to allow the rotation of the housing while providing a convenient manner of holding the device, or having a potentially messy situation in which the die which are not being stamped are exposed while the user is stamping the desired image.

A need thus exists to have a variety of images and related special effects in a simple, hand-held effects rubber stamp device which is convenient to use and inexpensive.

Furthermore, a need exists for a multiple die rubber stamp with multiple related special effects that can be easily manufactured on a mass production basis.

3. Solution to the Problem

The present invention provides a solution to the above problems by providing a special effects rubber stamp device comprised of a plastic stamp handle and a plurality of die mount units which are individually interchangeable upon the handle. A die mount unit of the rubber stamp device includes a stamp die permanently mounted thereto and is formed to reversibly attach to the handle of the rubber stamp device. The stamp die carries the imprintable image molded thereon. The handle is formed on an end to reversibly attach to a die mount unit of the rubber stamp device. A cavity is provided in the handle so as to contain the electronic circuitry necessary to provide a plurality of special effects messages and to correlated specific message or messages with the specific attached die mount unit of the rubber stamp device. A sensor mechanism is affixed within the handle, such as an array of individually operable pressure sensitive switches disposed beneath the attached die mount unit, in order to trigger the electronic circuitry to issue the specific special effect(s) correlated with the image of the attached die mount unit simultaneously with the imprinting of the visual image from the rubber stamp device upon the desired medium.

The interchangeable image special effects rubber stamp device of the invention enhances the business, entertainment, toy or novelty value of the conventional special effects rubber stamp of the Applicant's prior U.S. Pat. No. 5,178,067, and provides improved value and convenience over a multiple image rotating effects stamp of the Applicant's pending application Ser. No. 07/977,225.

Increased economy and play value compared to an effects stamp of U.S. Pat. No. 5,178,067 is achieved primarily by utilizing a single sound generating mechanism containing a plurality of sounds, an integrated multiple switching mechanism and a single handle to accommodate multiple die mount units. In digitally stored/replayed sound effects it is frequently possible to store and replay four or more sound effects for nearly the same cost as a single sound effect. This is so because of the standard sound chip memory sizes utilized by the industry, the programming of the available sound chips, and the sound quality expectations of the market. For example, a 2.8 second ROM digital sound chip (6K–12K bits/sec utilizing ADPCM sound compression) is standard sound chip for low end applications. It is manufactured in great quantities for many applications; and, hence is comparatively a very low cost device. This type sound chip is often selected for single sound devices; however, it can accommodate from one to eight separately stored and replayed sounds. Therefore, the interchangeable die mount rubber stamp device of the invention, providing multiple interchangeable images and multiple related sound effects provides a greater value to the consumer than existing special effects rubber stamp devices.

The interchangeable or switchable image, effects stamp of the present invention is more cost effective than a rotating, multiple image device of the Applicant's pending application Ser. No. 07/977,225 which is constructed with a handle mechanism and more convenient than such a device constructed without a handle. Furthermore, the switching mechanism required for the device of the present invention can be manufactured as a single, integrated unit, as discussed in detail elsewhere herein, thereby lowering the cost per message.

The present invention provides a variety of special effects including audible (speech, sound effects and/or music) and visual (light patterns and/or sequences, visual display), aromas, or a combination of sound, visual, and/or aromas. The message generating electronics of the present invention are contained within a cavity of the plastic handle so as not to interfere with the conventional operation or visual appearance of the conventional special effects rubber stamp.

Finally, the present invention can be quickly and easily assembled via mass production and is capable of being modified for different special effects.

SUMMARY OF THE INVENTION

The interchangeable image rubber stamp of the present invention produces a special effect when the stamp is pressed against a medium to be imprinted therewith. The special effects generated by the stamp can include audible (speech, sound effects and/or music) and/or visual (light patterns and/or sequences, graphic display) and/or aroma. The device provides a plurality of rubber stamp die images permanently affixed to a plurality of individual die mounts, which are themselves individually interchangeable upon the handle or housing of the rubber stamp device, and a plurality of special effects messages related to the images. A die mount with a stamp die permanently attached thereto is termed herein a die mount unit. A plurality of such units provide for the reversible, interchangeable attachment of a plurality of stamp images to the handle of the rubber stamp device of the invention. That is, each die mount unit can be reversibly attached, or affixed, upon and is interchangeable with each other die mount unit upon a handle of the rubber stamp device of the present invention. Furthermore, each die mount unit is formed in a manner so as to be identifiable uniquely from other die mount units of said plurality of units to enable correlation of the mounted image with the generated message for each interchangeable stamp. The stamp handle is formed on an end to reversibly attach with individual die mount units of the invention. A cavity in the handle of the rubber stamp device is formed to contain the electronic circuitry necessary to provide the special effects messages correlated with the specific interchangeable image attached, or affixed. A sensor mechanism is disposed within the rubber stamp device which is capable of uniquely identifying, in coordination with the attached die mount unit, each of the various individual die mount units as each is individually attached, or affixed, to the handle and of triggering the electronic circuitry to issue the respectively desired special effects message simultaneously with the imprinting of a visual image from the rubber stamp upon the desired medium. When a specific image, of said plurality of images, is attached to the handle and the rubber stamp is pressed against a medium imprinting a visual image the present invention produces special effects correlated with and specifically related to the attached image.

DETAILED SPECIFICATION

Figure 1:
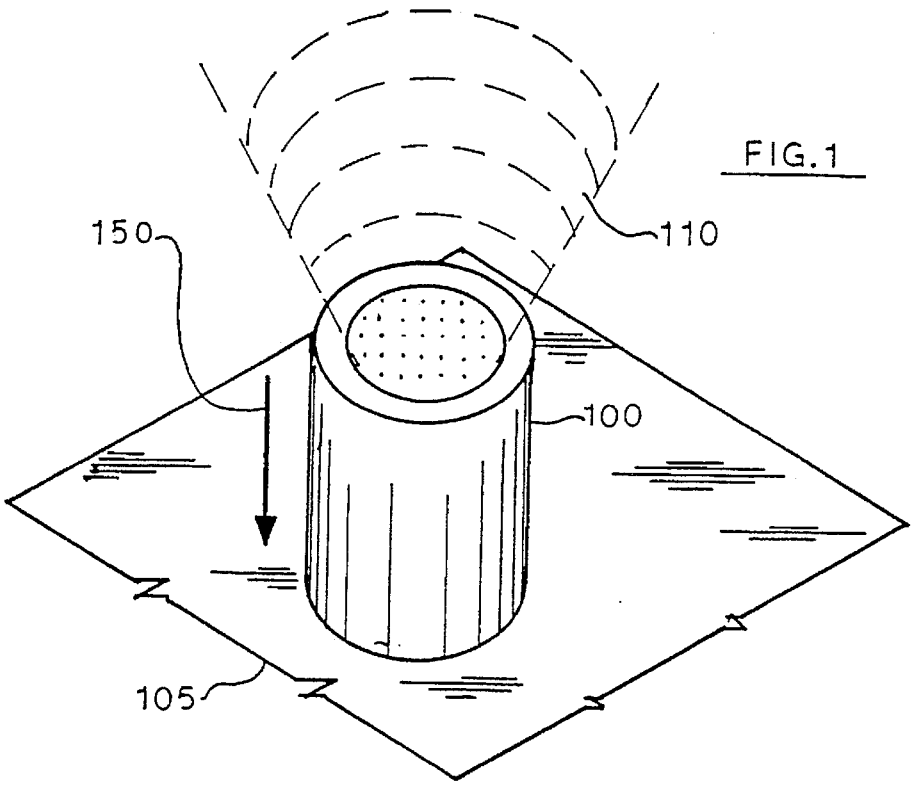
FIG. 1 is an illustration of the rubber stamp device of the present invention in operation, showing an audible message being generated in response to imprinting of a image contained on the rubber stamp.
Figure 2:
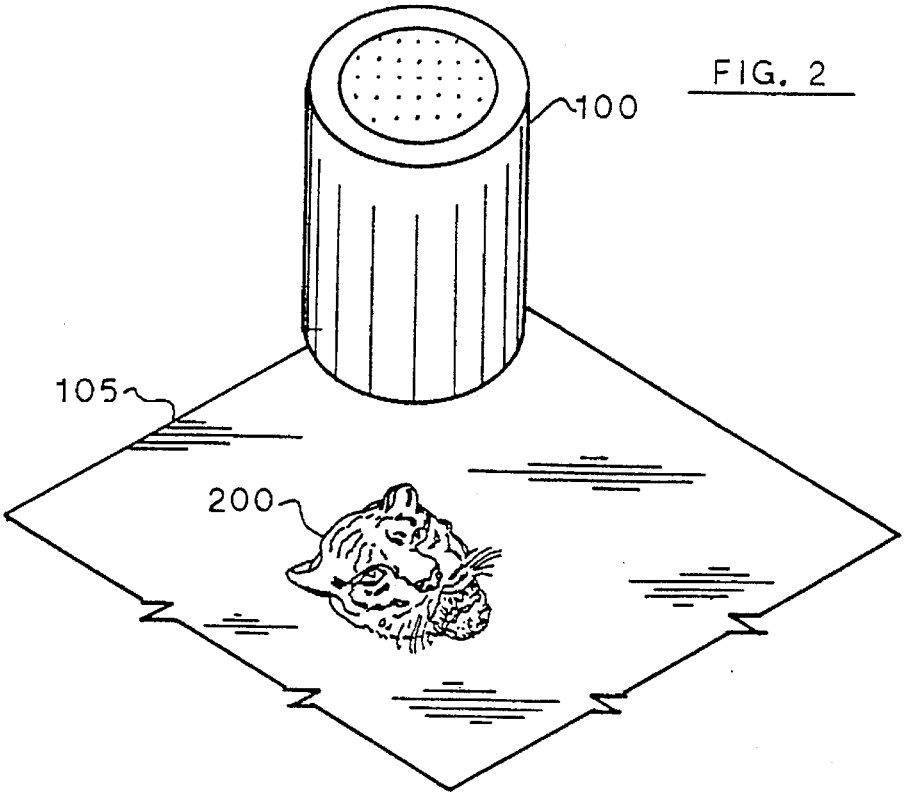
FIG. 2 shows the rubber stamp device and an imprinted image produced by the operation of the device.
Figure 4A:
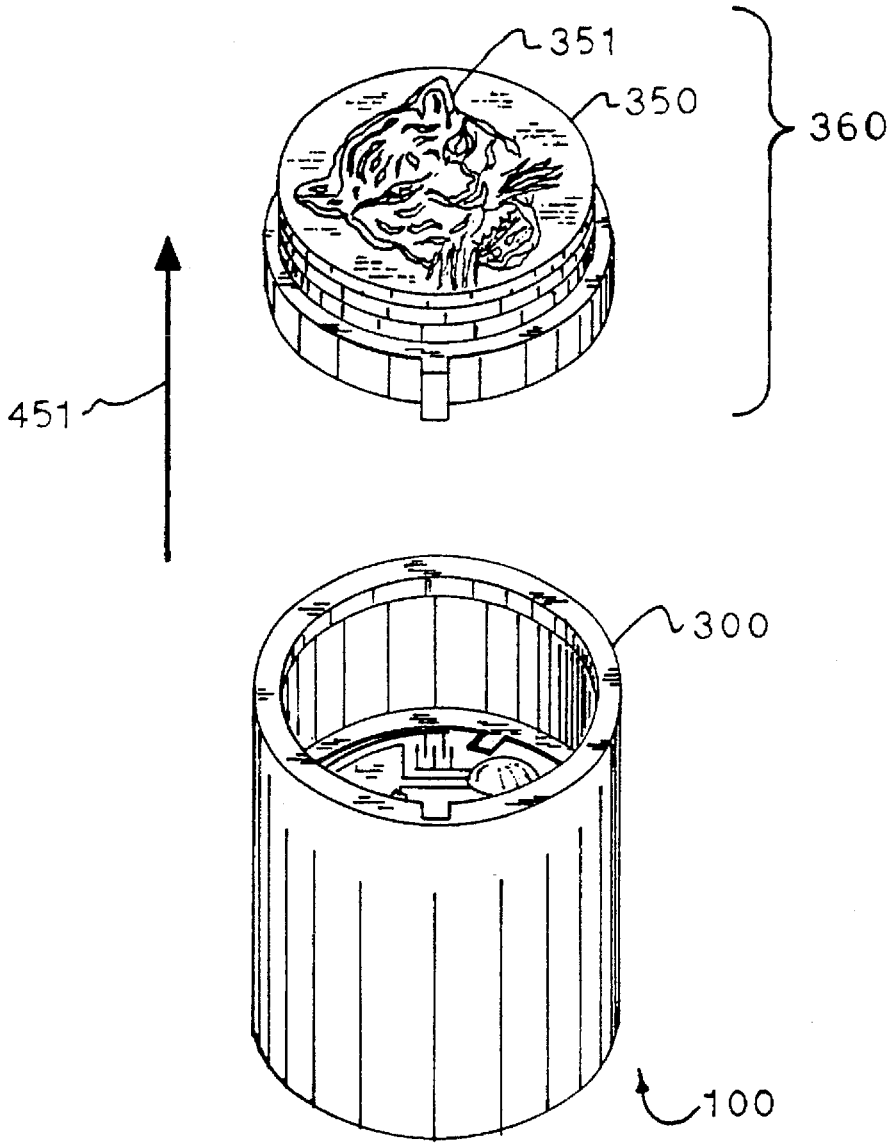
FIG. 4(A) is an illustration of the rubber stamp device of the present invention showing the detachment of the interchangeable die mount unit from the handle of the rubber stamp device, of the example of FIG. 1.
Figure 4B:
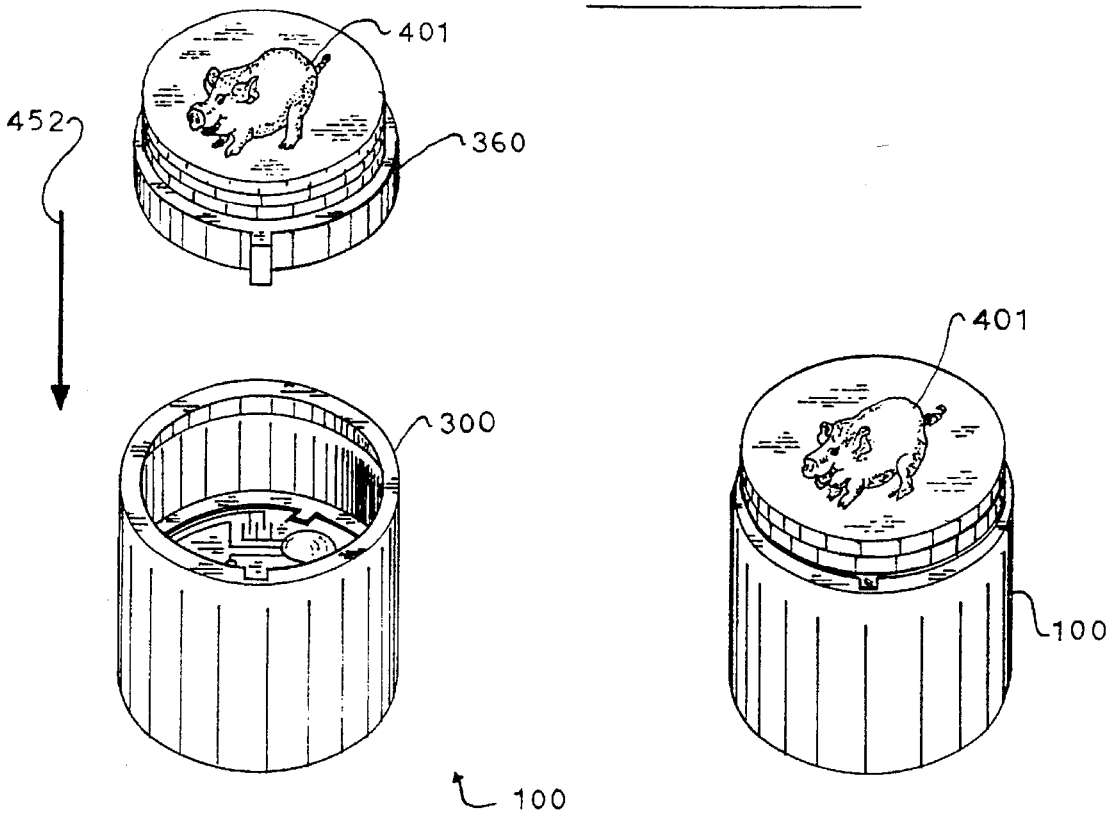
FIG. 4(B) is an illustration of the rubber stamp device of the present invention showing the attachment of a second die mount unit to the handle of the rubber stamp device.
Figure 4C:
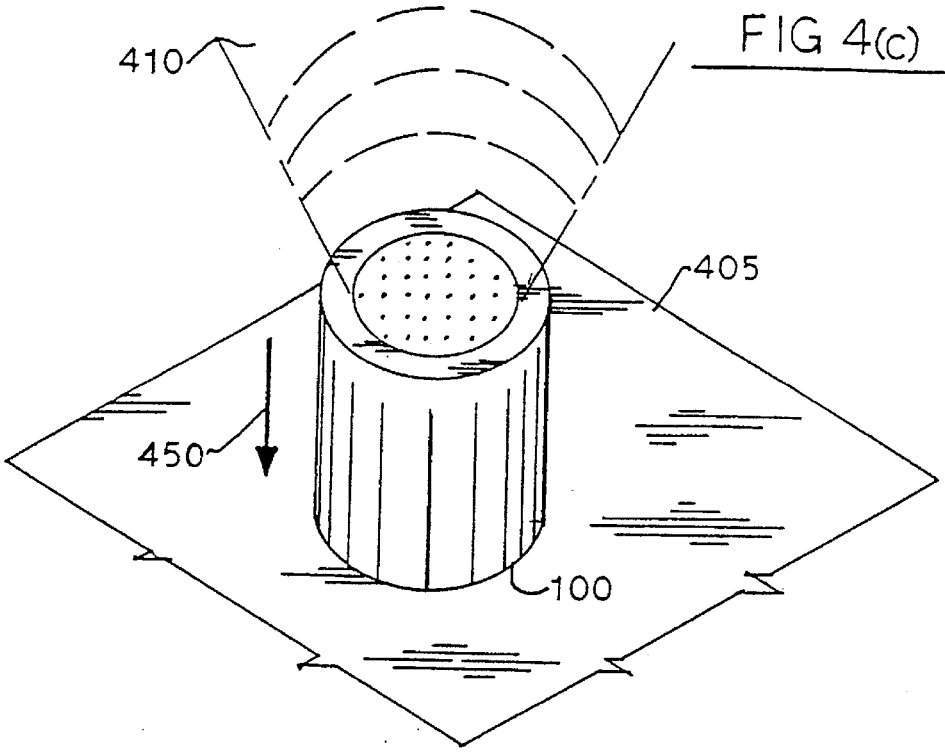
FIG. 4(C) is an illustration of the rubber stamp device of the present invention in operation, showing an audible message being generated in response to imprinting of a image contained on said attached second die mount unit.
Figure 4D:
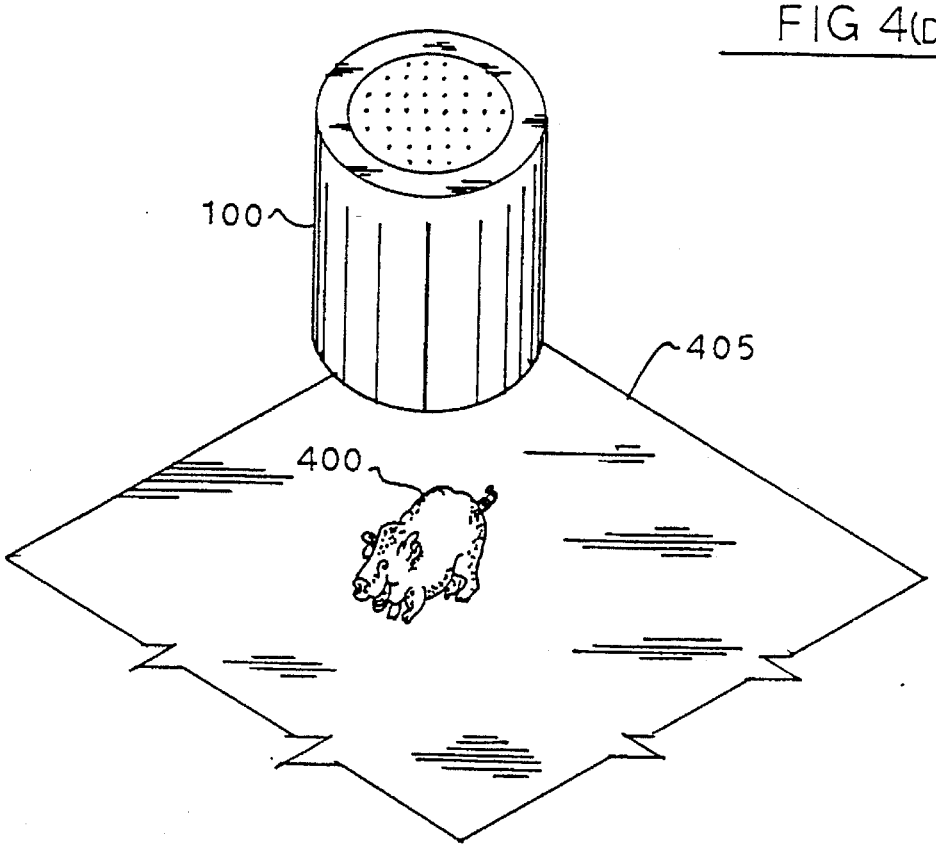
FIG. 4(D) is an illustration of the rubber stamp device of the present invention and an imprinted image produced by the operation of the device.

FIG. 1 illustrates the operation of the stamp device 100 of the present invention, showing a respective special effects sound message 110 being generated when the rubber stamp device 100 having a respective image mounted thereon is pressed in direction 150 against a medium, such as paper, to be imprinted 105. FIG. 2 shows the resulting imprinted visual image 200 on the medium 105. In the example of FIGS. 1 and 2 the sound 110 of a "roar" is produced upon imprinting. FIGS. 4(A) and 4(B) show the interchanging of images of the rubber stamp device 100. In FIG. 4(A) the reverse image of a tiger 351, used as demonstration in the examples of FIGS. 1 and 2, is removed by detaching the die mount unit 360, upon which the tiger image is permanently mounted, from the handle 300 of the rubber stamp device 100. In FIG. 4(B) a second die mount unit 360 containing the reverse image of a pig 401 thereon is attached to the housing 300 of the rubber stamp device. FIG. 4(C), in the manner of FIG. 1, illustrates the operation of the stamp device 100 of the present invention, showing a respective special effects sound message 410 being generated when the rubber stamp device 100 having a respective image mounted thereon is pressed in direction 450 against a medium, such as paper, to be imprinted 405. FIG. 4(D), in the manner of FIG. 2, shows the resulting imprinted visual image 400 on the medium 405. In the example of FIG. 4(C) a sound 410 representing "oink . . . oink" is produced upon imprinting. The particular sound 410 of the example automatically corresponds to the particular mounted image 400, in this example, a pig "oinking". Other audible message examples could be an elephant "trumpet" sound, or a train sound, or the spoken words "I Love You", a musical tune, the sound of a cash register. The message could also be lights or other visual display, aromas, or any combination of sounds, lights and/or aromas.

Switch mechanisms are disclosed which activate or trigger the special effects mechanism separately, or asynchronously, from the activity of imprinting an image.

1. Operation of the Rubber Stamp Device

Figure 3A:
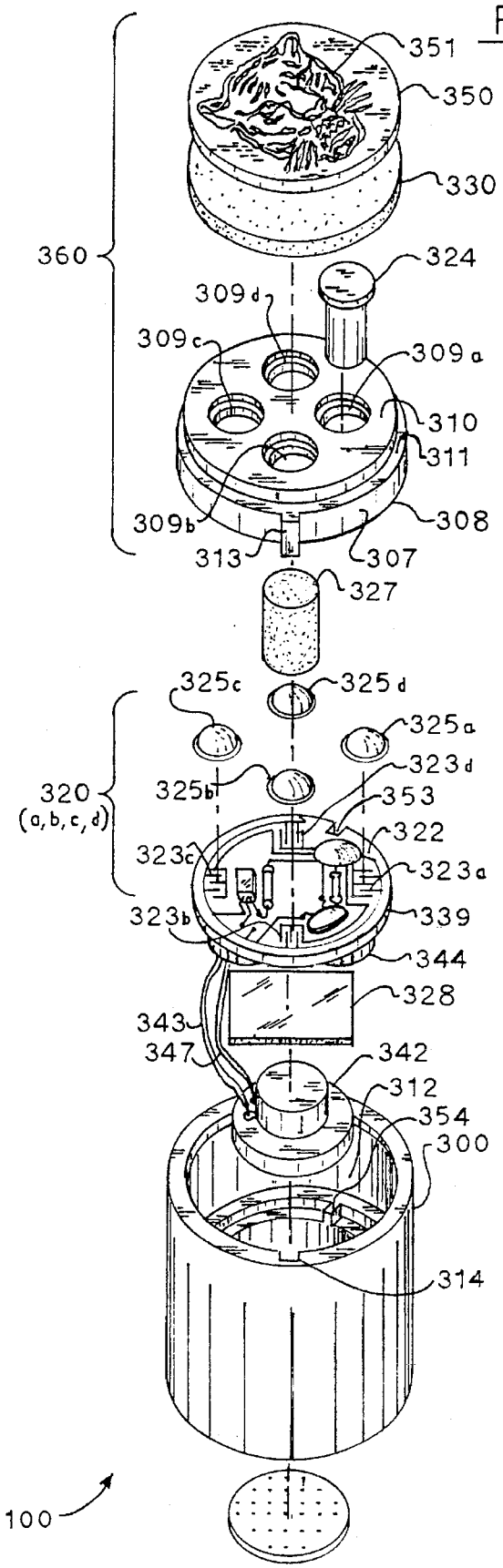
FIG. 3(A) is an exploded perspective view of the rubber stamp device.

FIG. 3(A) is an exploded perspective view showing the preferred embodiment of the rubber stamp device 100. In order to operate the rubber stamp device 100, the rubber stamp element, or die, 350 is typically pressed against an ink pad (not shown) and then pressed in direction 150 against the medium 105 to which the visual image 200 is transferred, also referred to as "imprinted". Alternatively, the stamp die 350 can be self-inking, in which case an ink pad is not required. It is to be expressly understood, however, that the method chosen for applying ink to the stamp die 350 is not a pertinent feature of the present invention. The rubber stamp die 350 contains a molded reverse image 351 to which the ink adheres and which transfers the ink image to medium 105 during imprinting. When the rubber stamp die 350 is pressed against the medium 105 an ink image is transferred to the medium 105, the special effects message 110 is generated. The present invention is capable of providing a plurality of interchangeable images. In the preferred embodiment of FIGS. 3 said plurality of interchangeable images are provided by having a plurality of die mount units 360 with respective die 350 and imprintable images 351 thereon. A die mount unit 360 of the present invention reversibly attaches to the handle, or stamp body, 300 to comprise a rubber stamp device 100 of the invention. The present invention is capable of providing a plurality of special effects with at least one special effect being related to the image of each of a plurality of the interchangeable die mounts 360 of the invention. The present invention is capable of uniquely identifying the presence of a specific image mounted thereon, in the preferred embodiment, by identifying the specific die mount unit 360 attached to handle 300 as discussed in more detail elsewhere herein, and of providing an effects message specifically related to said specific image when the rubber stamp die 350 is pressed against the medium 105 in the manner of transferring a visual image to the medium 105. Thus, the die mount containing the image of a tiger could be removed from the housing of the rubber stamp device 100 and a die mount containing the image of a pig attached to the housing with the result, that when the rubber stamp device is imprinted, a pig-"oinking" sound is generated by the rubber stamp device. The present invention is capable of providing a variety of special effects 110 including audible effects (sound and/or speech and/or music), light (patterns and/or sequences and/or visual displays such as LCD), and/or aromas.

It is to be expressly understood that a rubber stamp device of the present invention could be manufactured having a plurality of interchangeable images such that more than one said image could be mounted to the handle at the same time, and such that special effects messages related to each mounted image are generated upon imprinting thereof. It is also to be expressly understood that one or more effects messages could be expressed with several different images under the teachings herein depending upon the desired relationship between image and message.

Furthermore, the present invention contemplates other hand held imprinting devices and image transfer devices than specifically those known as rubber stamp devices. It is to be understood, that the term rubber stamp is used herein in its most general and generic sense and that some hand held imprinting devices may have images established on other than rubber or rubber-like materials and these are specifically anticipated under the teachings herein (there are, for example, many hand held devices which can be said to "carry" an image and to transfer or generate that carried image to a target object). Also, for example, hand held embossing devices or hand held devices for multi-color image imprinting, if embodied with special effects related to the images thereon are anticipated under the invention herein.

2. Interchangeable Die Mount

Figure 3B:
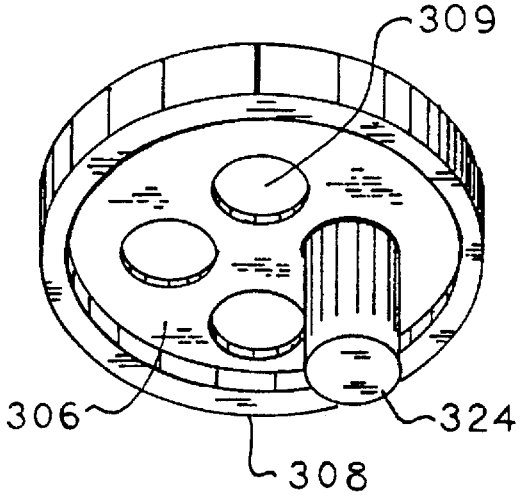
FIG. 3(B) is a perspective view of the die mount unit viewed from beneath and revealing the actuator.

Refer to the exploded perspective view of the preferred embodiment of the rubber stamp device of FIG. 3(A). The interchangeable die mount unit 360 of the preferred embodiment of FIGS. 3 is comprised of the interchangeable die mount 308 which is typically formed from plastic, a foam pad 330, a switch actuator element 324 and the stamp die 350 upon which is molded a unique reverse image 351 to be imprinted. The a switch actuator element 324 is inserted through a predetermined hole 309(*a,b,c*, or *d*) in the die mount 308 during assembly of the pieces comprising the die mount unit 360. The actuator element 324 of the preferred embodiment is formed from a hard rubber-like compound, but could also be formed from many other materials, such as, for example, plastic, or electrically conductive hard rubber. The preferred manner of assembling actuator element 324 makes the actuator of the device resistant to breakage under frequent interchanging of die mount units 360 by the user. It is to be expressly understood, however, that many types of actuator elements could be employed under the teachings of the present invention. For example, a plastic extension actuator element could be molded as a part of the underside 306 of die mount 308, or an actuator extension could be affixed to the underside 306 of die mount 308 with adhesive or such, in a manner to engage the appropriately the bridge element 325(*a,b,c*, or *d*). An actuator could be a molded extension of the attachment surface of the rubber stamp die disposed in a manner to extend through a hole in the mounting surface 310 of the stamp mount 308 when assembled thereto. An actuator extension could be formed from conductive material and disposed upon the underside 306 of die mount 308, in a manner to engage and actuate a said switch contact element 323 (*a, b, c,* or *d*) thereby eliminating the need of an additional bridge element components 325 (*a, b, c, d*).

Figure 5:
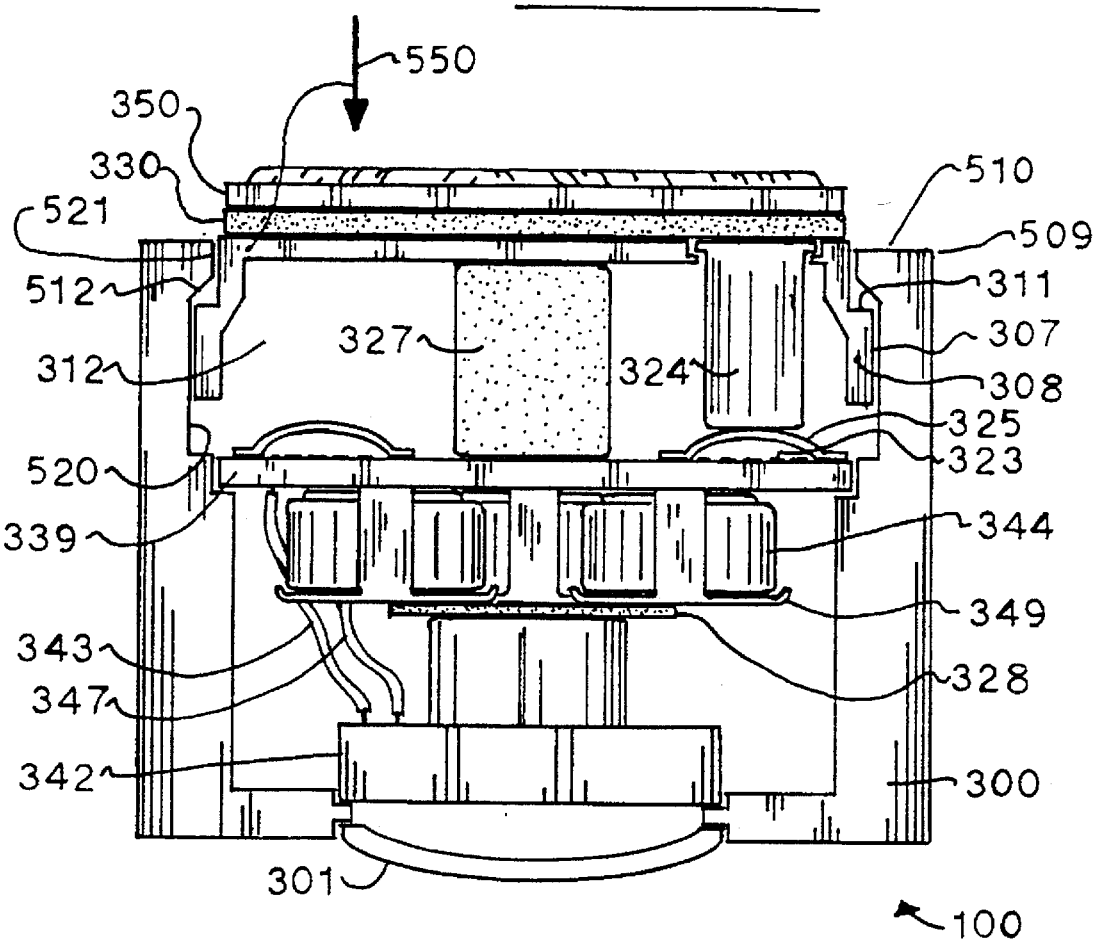
FIG. 5 is a cross-sectional view showing the placement of the internal components of the rubber stamp device, with some circuit board components left out for clarity.

Typically the foam pad 330 and stamp die 350 are glued to one another in the disposition indicated in FIGS. 3(A) and 5 and to the die mount surface 310 with a rubber cement or similar adhesive. The die mount 308 surface 310 provides a flat, circular shaped area for the stamp die 350 to mount. Shapes other than circular are certainly possible, such as rectangular or oval. In the other dimension, i.e. perpendicular to the plane of the die mounting surface 310, the die mount of the preferred embodiment extends to form a generally cylindrical shape, the wall 307 thereof being generally perpendicular to the die mount surface 310. Around the arcuate surface of the cylindrical wall 307 a ridge 311 is formed as shown in FIG. 3(A). As shown in the FIG. 5 cross section view of internal components of the preferred embodiment, the housing 300 is formed as a hollow cylindrical shape having multiple adjacent internal radiuses of different dimension. The largest said radius 520 tapers 512 to a smaller radius 521 to form an inward projecting flange or collar 510 at the die mount end 509 of housing 300. Ridge 311 of the die mount 308 reversibly snaps into cylindrical cavity formed from the radius 520 of housing 300 (FIG. 5) of the rubber stamp device 100 and the die mount unit 360 thereby being reversibly retained within said housing. The cylindrical wall 307 of die mount 308 is manufactured in a manner to allow said wall to reversibly flex providing for the insertion and removal of ridge 311 past retaining rim 510. Said wall is compressed to allow said ridge to move past 510 and then said wall is allowed to expand with said ridge thereby being locked behind said rim. The transition between said larger radius and said smaller radius cylindrical cavities is tapered 512 to provide mechanical advantage for flexing said flexible wall 307 inward during removal of die mount unit 360. The cylindrical wall 307 of die mount 308 is parallel to the inner cylindrical wall of cavity 312 of housing 300 when assembled therein, and has a radius several thousandths of an inch smaller than 520, thereby allowing mount 308 to be freely translated within cavity 312 along the cylindrical axis of housing 300.

Notice in FIG. 3(A) a rectangular shaped extension 313, a key extension, extending radially outward from the arcuate surface of the die mount wall 307 and oriented with its long dimension perpendicular to die mount surface 310. The die mount 308 of the preferred embodiment contains one key extension 313 which is formed to slide smoothly into a key cavity, or channel, 314 molded into in the inner facing arcuate surface of housing 300. The key extension 313 and key cavity 314 are brought adjacent and fitted together, engaging, during reversible assembly of die mount unit 360 to housing 300 thus maintaining a predetermined and fixed rotational disposition between said mount unit 360 and said housing 300 of the rubber stamp device 100. The key slot 314 of FIG. 3(A) proceeds down the inner wall of housing 300 to ensure that the mount unit 360 stays in proper orientation for appropriate switch activation during translation thereof. It is to be expressly understood that other key/cavity designs could be employed hereunder, for example, the key could extend from the inner wall of the housing and the cavity extend into the wall of the die mount. Many other keying arrangements are possible to ensure advantageous operative relationship between the actuator 324 and the appropriate switch of 320 (*a, b, c,* or *d*) and these are anticipated within the present invention.

The interchangeable, translatable die mount unit 360 employed in the preferred embodiment allows for the interchanging of different imprintable images, the individual actuation of activation switches, and predetermined correlation between a unique stamp image attached thereto and the respective special effects provided upon operation of the rubber stamp device. Said correlation is accomplished through an advantageous combination of a predetermined location of switch actuator element 324, a predetermined rotational disposition between mount 360 and housing 300 (some anticipated approaches discussed above), and a predetermined disposition of switches 320 (*a,b,c,* and *d*) and wafer circuit element 322 (discussed in detail below). There are many methods which could be employed by those skilled in the art to achieve such a predetermined correlation of special effects with respectively mounted interchangeable stamp images under the teachings of the present invention. For example, an actuator element having a single, advantageous location upon the die mount unit and a plurality of key cavities advantageously disposed around the inner-facing radius of the housing within which the key would fit could be employed to predetermine a plurality of rotational dispositions corresponding to die mount units having unique images. It is to be expressly understood that it is expected that those skilled in the art will employ many different techniques of assuring or allowing a correlation between the respective special effects provided and the respective interchangeable stamp image under the teachings of the present invention.

Furthermore, although they represent the preferred embodiment, it is not a limitation of the invention herein that a said specific correlation between reversibly mounted images and sound effects generated upon activation be automatically assured, or that activation itself only occur automatically with imprinting. For example, a device of the present invention could employ a multiple position switch disposed upon the handle of the device being operatively connected to enable a user to manually select a sound determined by the user to be appropriate to a specific reversibly attached image which is generated when an actuator is activated upon imprinting. In such a design, the switch for selecting the special effects message could be different from the switch which actuates the playing of the message. Therefore, a single actuator switch could be used in combination with a special effects selector switch; the effects selector switch being manual as described above.

Additionally, a keyed switching arrangement between the die mount unit and the message circuit could be employed in a device of the invention to automatically select the effect related to the respective image thereon when the respective mount is attached to the handle, and a single activator switch employed to actuate the selected effect upon imprinting. It is to be expressly understood that the processes of special effect selection and special effect activation as employed within the present invention may be implemented to occur separately or together. Different combinations of manual and/or automatic effects selection and activation are anticipated in the present invention. An actuator (to activate the message circuit), for example, could be a finger-operated button mounted on the handle of the device in combination with the automatic selection mechanism described above.

Refer now to FIGS. 4(A), 4(B), 4(C), and 4(D). FIG. 4(A) shows a perspective view of the rubber stamp device of FIG. 1 revealing the die 350 containing an image 351 of a tiger molded thereon from which a visual ink image 200 is produced when the device is imprinted as described above. FIG. 4(A) further shows the die mount unit 360 being removed from the housing 300 by pulling in the 451 direction. FIG. 4(B) shows a die mount unit 360 containing an image 351 of a pig thereon being attached to housing 300 of the rubber stamp device 100 by pushing in the 452. FIG. 4(C) shows the rubber stamp device 100, assembled, being operated in a manner of the rubber stamp device of the invention with an audible message 410 being generated when the rubber stamp device 100 is pressed in direction 450 against a medium, such as paper, to be imprinted 405. FIG. 4(D) shows the resulting imprinted visual image 400 on the medium 405. In the example of FIG. 4(C) the sound 410, a pig-"oinking" sound, is produced upon imprinting. A vast variety of images could be used in the invention, including images of, for example, different animals, vehicles, sports activities, personalities, and so forth. The interchangeable die mount stamp of the present invention allows the user to select different images from a variety of available images to mount and imprint. When a selected image is mounted, in the preferred embodiment via the associated die mount, and imprinted, the device of the present invention generates a message related to the visual image produced.

In the preferred embodiments of FIGS. 4(A), 4(B), 4(C), 4(D) two unique images are interchanged upon the handle 300 of the rubber stamp device of the present invention by employing a mechanism of two interchangeable die mounts 308 containing the unique images permanently mounted thereupon. It is to be expressly understood that this method is not limited to the interchanging of two unique images, but could be applied to a plurality of such images each upon an interchangeable die mount. Also, said attachment method could be employed to permanently attach a single image stamp with the housing of the rubber stamp device. It is expected that those skilled in the art will employ many approaches to provide for the interchanging of different imprintable images of the rubber stamp device under the teachings of the present invention. For example, a device could be constructed in which just the die (or the die and a foam pad) could be interchangeable upon the mount, said mount being, as in traditional rubber stamps, the handle of the rubber stamp device. Such a device could be designed, for example, by having a piece, such as a retaining ring, which fits over the stamp die around its perimeter area (the perimeter area being molded to be "below" the image printing surface of the die) reversibly affixing to the mount (for example, snapping into place) thereby reversibly holding the die in-place. In a stamp device having a rectangular mount end, reversibly interchangeable mount plates holding different images could be individually inserted from the side of the housing using a track-guide arrangement. It is also possible to mold a rubber stamp die to have a cylindrical extension of the rubber die material proceeding in the direction away from the imprintable surface of the die to form a rubber cap-like shape with the molded image on the flat exterior end. Said molded cap-die being formed from reversibly expandable rubber type material could then be snapped over the end of the rubber stamp housing thereby eliminating the need for a separate die mount component. (Such an approach, of course, necessitates different switching arrangements than employed in the preferred embodiment.) It is to be expressly understood that there exist many methods to achieve an interchangeable image for imprinting. It is anticipated that those skilled in the art will employ many methods to achieve the interchangeable image of the present invention.

It is also to be expressly understood that many methods of reversible attachment exist that can be utilized under the teachings of the current invention to reversibly attach a die mount unit or a die alone to a housing of the rubber stamp device to achieve an interchangeable image effects stamp of the invention and these methods, likewise, are anticipated under the teachings of the present invention. Additionally, other means than die could be employed in a hand held device to hold and transfer an image, and these means, if employed with related special effects are anticipated under the teachings herein. For example, hand held devices which print an image via heat or light upon an object suitably designed for such printing are anticipated under the teachings of the present invention, if such devices employ special effects related to said printed images.

Typically housing 300 and die mount 308 of the rubber stamp device of the invention are formed of plastic material; however, other materials could be employed, such as wood.

Furthermore, other alternative designs of interchangeable image effects stamps are anticipated under the present invention, such as, an interchangeable image rolling type effects stamp. In such a stamp, the die holding the transferrable image is normally mounted around the arcuate surface of a cylindrical mount. An axle of the mount allows it to be attached to a handle and rotated during imprinting to transfer the image to an object, such as a piece of paper. In an interchangeable image rolling effects stamp, a plurality of such mounts having different images mounted thereon are interchangeable upon said handle. Within the handle is an effects circuit capable of being activated to generate an effect associated with the image of the mount attached to the handle during imprinting of the image. The effects circuit could uniquely detect a specific mount attached to the handle through a keying arrangement of the attachment, or a hand operated switch could be provided upon the handle with a position for each mount available for attachment.

3. Multiple, Selectively Operable Pressure-Sensitive Switch Mechanism

The special effects message 110 is produced in response to the creation of the image 200. For example, the message 110 could be produced in response to a predetermined amount of pressure that is applied to a momentary contact, pressure-sensitive activation switch 320 (*a,b,c*, or *d*) as a result of the rubber stamp die 350 being pressed against the medium 105.

In the preferred embodiment, as shown in FIG. 3(A), four independently and selectively operable pressure-sensitive activation switches 320(*a*), 320(*b*), 320(*c*) and 320(*d*) of the type used in the rubber stamp device 100 are comprised of, for example, electronic circuit contact wafer 322 having four electrical contacts 323(*a*), 323(*b*), 323(*c*), 323(*d*) and corresponding reversibly flexing conductive bridge elements 325(*a*), 325(*b*), 325(*c*) and 325(*d*) each separated to electrically open position by the formed shapes thereof. The contact wafer 322 typically contains four printed circuit contact elements 323(*a*), 323(*b*), 323(*c*), 323(*d*) each element comprised of two closely-spaced conductor runs disposed essentially parallel to one another in a serpentine or maze-like pattern on the surface of the contact wafer 322. The particular shape of the conductor runs is not a pertinent part of the invention, but should provide for an advantageously long length of adjacent conductors in minimal contact wafer area. The four contact elements 323(*a*), 323(*b*), 323(*c*), 323(*d*) are typically disposed at equal spacings around the contact surface of the contact wafer 322 near the perimeter, as shown in FIG. 3(A). The contact wafer 322 is formed from printed circuit material, such as a phenolic. In the preferred embodiment, the contact wafer 322 shares a portion of the surface of the electronic circuit board material of the device, labeled 339; however, it could be established as a separate component. Bridge elements 325(*a*), 325(*b*), 325(*c*) and 325(*d*) are manufactured from conductive, flex-metal material formed in a generally domed shape which is reversibly deformable. When a domed shaped bridge element 325 (*a,b,c*, or *d*) is pressed against the respective contact element 323(*a,b,c*, or *d*) lying thereunder it causes the respective switch 320 (*a,b,c*, or *d*) to "close," i.e., the respective bridge element 325 (*a,b,c*, or *d*) allows current to flow between the two conductors of the respective contact element 323 (*a,b,c*, or *d*).

Note that said bridge elements are mounted to the circuit contact wafer 322, see FIG. 5, and disposed in a manner to cover the said adjacent conductor runs of respective contact elements 323 (*a,b,c*, and *d*), and, further note that the domed shape of the bridge elements causes them to remain normally separate from said conductive runs lying thereunder, thus determining said switches 320 (*a,b,c*, and *d*) of the preferred embodiment to be in a normally open position. Note further, as shown in FIG. 5, that the stamp mount unit 360, including attached actuator 324, of the preferred embodiment is disposed so as to be reversibly translatable in the 550 direction within housing 300. When pressure is applied to a predetermined bridge element 325 (*a,b,c*, or *d*), such as when the rubber stamp device 100 is pressed against a medium 105 thereby causing stamp mount unit 360 to be translated in the 550 direction and actuator 324 affixed in predetermined hole 309 (*a,b,c*, or *d*) to be pressed against a predetermined bridge element 325 (*a,b,c*, or *d*), the domed shape of said bridge element is deformed inward to allow the predetermined bridge element 325 (*a,b,c*, or *d*) to short across the two conductors of the respective contact element 323 (*a,b,c*, or *d*), thus "closing" the respective, predetermined switch 320 (*a,b,c*, or *d*) and activating the electronics of the message circuit 340 to play the predetermined respective special effects message. For example, when actuator 324 is disposed in hole 309(*a*), and die mount unit 360 is translated in direction 550, such as when the image 351 of rubber stamp device 100 is imprinted, bridge element 325(*a*) is caused to deform and short across the conductors of contact element 323(*a*) thereby "closing" switch 320(*a*). When said pressure of imprinting the rubber stamp device is removed the respective flex-metal bridge element 325(*a*) springs back to its original domed shape reversibly translating the die mount unit 360 and separating itself from the conductive runs thereby returning the switch to the normally open position. Note also, that a reversibly deformable, non-conductive element 327 may be affixed permanently to either the circuit board or to the underside of the die mount to ensure that the force of translation of the die mount does not twist or jam the die mount within the housing as the stamp is imprinted. Additionally, a non-conductive foam spacer 328 may be affixed to the underside if the circuit board to add structural strength to the board during imprinting.

In the preferred embodiment, shown in FIG. 3(A), during assembly of the die mount unit, a single actuator 324 element is placed in a predetermined location of the die mount correlating with the imprintable die image mounted thereon. Upon operation of the rubber stamp device of the invention this actuator element actuates one of four available switches, predetermined by the disposition of said actuator element upon assembly with the housing of the rubber stamp device, thereby causing the message circuit to generate the predetermined special effects message related to a predetermined visual image. It is to be expressly understood that, in addition to the many manners mentioned above in which an actuator of the invention could be designed, many switch types could be utilized under the teachings of the present invention. For example, the actuator itself could be manufactured from a conductive, rubber-like material, or a flex-metal extension attached to the die mount unit, thereby eliminating the need for the flex-metal bridge elements 325(*a,b,c*, and *d*). In such a design, a reversibly deformable non-conductive element, such as a rubber pad 327 in FIGS. 3(A) and 5, could be disposed so as to be firmly positioned between the contact wafer and die mount unit, in a manner so as to not interfere with the reversible contact between said conductive actuator and the conductive runs thereunder. Said rubber pad separates said conductive actuator element and conductive runs thereunder to establish a normally open switch 320, and, further, to provide for reversible action of the switch. Additionally, in a design minimizing manufacturing costs, the mounting surface 310 of the die mount unit 360 could be manufactured to itself reversibly flex, thereby eliminating the need for the entire unit to translate within the housing. Also, composite actuator/bridging element devices well-known in the industry could be used within the present invention. These devices are composed of a conductive and non-conductive rubber part, with the non-conductive parts normally resting upon closely spaced conductive circuit run pairs and supporting the adjacent conductive portion of the actuator/bridge device directly above said run pairs. Application of pressure upon the top of such a device, in the direction toward the circuit, causes the non-conductive portion to compress and allows the conductive portion to engage the conductive runs thereunder, causing the switch to "close." Additionally, under the teachings of the present invention, logic could be designed into the message circuit to allow for interpretation of combinations of switches closing. This could be used, for example, in situations where contact wafer space is at a premium. In such a system two contact elements would be used in combination with one or two actuators to generate three different combinations of switch closing, three contact elements with one, two or three actuators to give seven switch combinations, etc.

It is to be expressly understood that, although the example of FIG. 3(A) shows four independently operable switches 320 (*a,b,c*, and *d*) with the manner of switching being one switch actuated for each image/message combination, it is anticipated that different numbers of switches, switching logic and switching technology will be employed by those skilled in the art under the teachings of the present invention. Different numbers of switches may be employed, for example, depending upon the number of image/message combinations desired and/or the manner of switching utilized.

Furthermore, the present invention anticipates the design of switch actuation to occur with a predetermined amount of pressure. Said predetermined actuation pressure can be employed, for example, to allow the user to control the message generation to occur only when imprinting. The user, for example, would ink a rubber stamp of the invention using an amount of pressure insufficient to actuate the switch and then imprint said stamp with a pressure sufficient to actuate the switch and cause a message to be generated.

Additionally, an inhibit switch could be utilized to inhibit the generation of a message upon imprinting of an image of the device.

Additionally, a switch could be provided which operates in a manner asynchronously with the imprinting of the rubber stamp device. Such a switch could be, for example, a momentary contact, pressure sensitive switch disposed on the side of the handle of the rubber stamp device of the present invention. Such an asynchronously operating switch is actuated, for example, with a finger push and the effects message is generate, in addition to or separately from the generation of a message in response to imprinting. Other switches could be used within the present invention, such as for example, accelerometers to sense the force of impact of the rubber stamp 100 and mercury tilt type switch to provide for the actuation of the message circuit based on an angle of the rubber stamp 100 during the process of imprinting.

4. The Message Circuit

Figure 6:
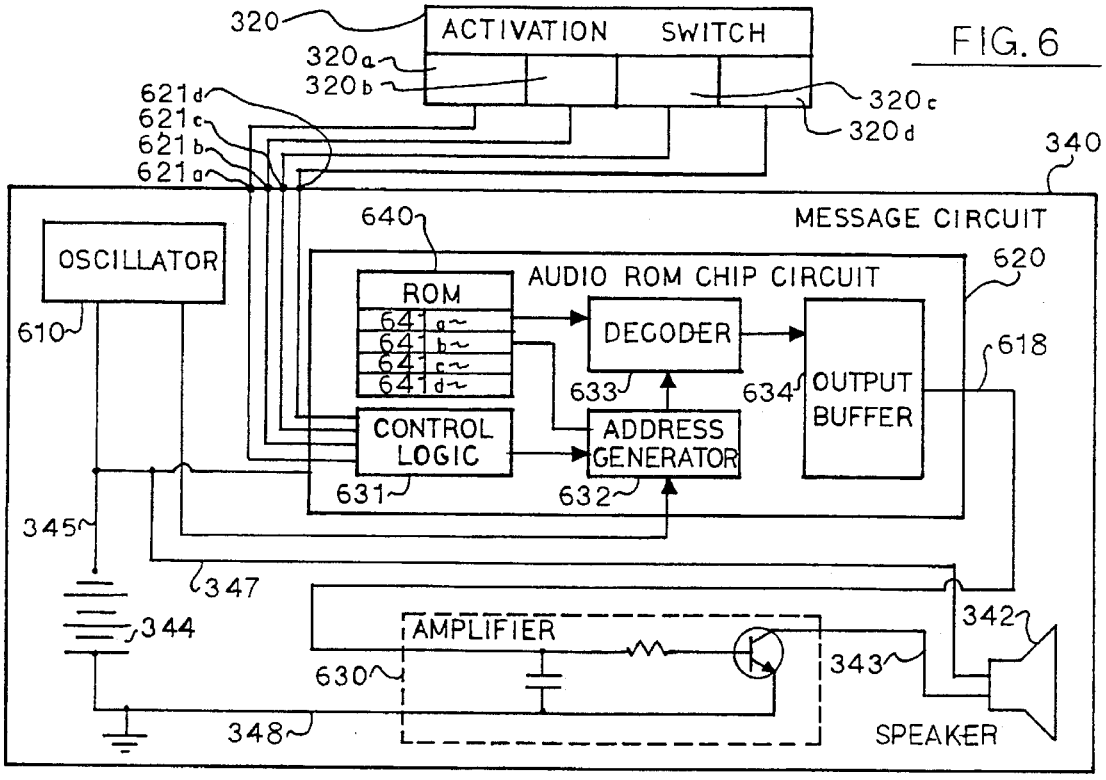
FIG. 6 is a block schematic diagram of the message circuit used to generate an audible message.

FIG. 6 is a block diagram showing the preferred embodiment of the present invention using an electronic circuit 340 to generate an audible message 110. Each normally open contact 323 (*a,b,c,d*) of the momentary contact, multiple contact switch 320 (*a,b,c,d*) is operatively connected to the message circuit 340 respectively via leads which are comprised of conductive runs disposed upon the electronic circuit board material 339. The message circuit 340 is mounted upon circuit board 339 and contact wafer 322 is also established thereon. The circuit board 339, which in the preferred embodiment contains the message circuit 340 and switch array 320 (*a . . . d*), is keyed to assemble in a predetermined orientation within housing 300 via advantageous engagement between notch 353 and key extension 354 (see FIG. 3(A)).

The message circuit 340 is typically powered by a 3, 1.5 volt batteries 344. In the preferred embodiment the batteries are removably mounted via conductive retaining clips 349 to the underside of circuit board 339. Disposed on the underside of circuit board 339 so as to electrically engage the inward facing ends of said mounted batteries, are three conductive circuit pads. Said conductive pads and retaining clips electrically connect with circuit board runs and convey the battery power to the message circuit 340 via leads 345 and 348. In other designs the batteries could, for example, be contained in a separate battery compartment. In one embodiment of the present invention, the batteries 344 remain permanently connected in the message circuit 340, with the batteries also being permanently installed in the rubber stamp device 100. In an alternative embodiment, a power switch (not shown) can be connected between the batteries 344 and the message circuit 340 components. Providing a power switch would allow the rubber stamp device 100 to be used without producing the special effect(s). In the preferred embodiment, the batteries can be changed through the opening created when the interchangeable die mount unit 360 of the rubber stamp device is removed from housing 300 and the circuit board 339 is removed through the resulting opening.

Whenever a switch 320 (*a,b,c*, or *d*) is closed, the audio ROM chip circuit 620 is activated via a circuit run operative connection with respective input 621(*a,b,c,d*). In the preferred embodiment of FIG. 6 the audio ROM circuit, sometimes known as a "voice ROM", "sound chip" or sound circuit, is capable of detecting the closure of each switch 320 (*a,b,c,d*) respectively via circuit runs operatively connected thereto and to its inputs 621 (*a,b,c,d*). The audio ROM chip circuit 620 of the preferred embodiment has sound effects digitally stored in mask ROM 640 which simulate, for example, a human voice, or an animal, or a machine, or music, or which may be indicative of other sounds. In the preferred embodiment of FIG. 6 sound effects are stored in the audio ROM chip as four individually playable sound segments 641 (*a,b,c,d*). Play-out of a sound effects segment 641 (*a,b,c*, or *d*) corresponds in a predetermined manner with closure of momentary contact activation switches 320 (*a,b,c*, or *d*) via said operative connections. For example, when switch 320(*a*) is actuated the audio ROM detects said actuation at respective input 621(*a*) via its respective operative connection to switch 320(*a*), selects stored sound segment 641(*a*), and outputs that sound segment in a manner described below, likewise, when 320(*b*) is actuated sound segment 641(*b*) will be output, etc. As described in detail above, in the preferred embodiment there is a predetermined correlation between attached stamp mount unit 360, actuator 324 and a specific activation switch of 320 (*a,b,c,d*) which is actuated upon imprinting of the rubber stamp device 100 of the invention, thus insuring a predetermined correlation between each interchangeable image of the rubber stamp device and the message or messages generated upon operation thereof. Individually playable sound segments, such as for example animal sounds, could be stored as four individually playable sound data segments 641(*a,b,c*, and *d*) of the invention, respectively: a tiger "roar" sound, an elephant "trumpet" sound, a monkey "squeal" sound, and a snake "hissing" sound, and each played-out as message 110 in response to imprinting of the related visual image. For example, when a mount unit 360 containing an image 351 of a tiger is mounted switch 320(*a*) is activated upon imprinting, and sound segment 641(*a*), a "roar" is played, whereas, when a mount unit 360 containing an image 351 of an elephant is mounted switch 320(*b*) is actuated upon imprinting and an elephant "trumpet" sound is output. It is to be expressly understood that the invention is not limited by the specific number of sound segments 641, or the number of operative inputs 621 of the FIG. 6 Message Circuit, the number of each being an implementation decision regarding devices developed under the teachings of the present invention. It is anticipated that other numbers of segments and inputs will be employed under the teachings of the present invention by those skilled in the art. Likewise, it is to be expressly understood that the manner of play-out of sound segments of the preferred embodiment of FIG. 6 is not a limitation of the present invention. Many methods of play-out of sound segments are well known in the art and well supported with current technology. For example, well known in the art and under the teachings of the present invention, the activation of a specific switch could cause the automatic play-out of several segments, or could cause the play-out of a random segment or segments. Such an implementation of the present invention could be utilized in a Christmas stamp, for example, when a Santa image is mounted successive imprintings could cause one of several carol tunes to play randomly and when a reindeer image is mounted several other tunes are likewise activated to play. Another implementation under the teachings herein could be an "8 Ball" style of operation (i.e. a question is posed and a stored answer from a group of stored answers is randomly provided), wherein each mounted image imprints a question or visual situation and the imprinting thereof causes play-out of a random answer message from a large group of sound segments. A game could be created, for example, in which the movement of pieces on an associated board (or the position of the next stamp imprint) is determined by a random relationship between an imprinted image of the invention and the accompanying message played-out upon imprinting of the device 100 on a medium 105. Furthermore, a multiple contact, hand-operable switch could be provided on the handle of the rubber stamp device to enable the user to pre-select the sound segment from a group of available segments to be played-out upon imprinting of the visual image (i.e., the user could thereby be allowed to determine the correspondence between imprinted visual and the specific effects message thereby generated.) It is expressly noted that in an embodiment with random sound segment play-out, the messages remain related to the visual images in that there is always a predetermined group of possible message responses to a predetermined group of visual images and each possible association of image and message has meaning in its context (i.e., a surprise "answer" in the "8 Ball" example and a specific game move or result in the "board game" example.). The message circuit of FIG. 6 could also be provided with logic to require a predetermined duration of switch actuation in order to generate a message. This would be used, for example, as a game to allow time for a user to guess the sound response (i.e. message circuit programmed to automatically play following a predetermined time interval initiated upon activation switch actuation.) It could also be used, for example, as a functional enhancement to allow the process of stamp inking to be accomplished without generation of a message, allowing the user to control the message generation to occur only when imprinting (i.e., the message circuit programmed to require a predetermined time interval of actuation so that the user could ink the stamp using an amount of time insufficient to cause generation of a message, while holding the stamp down sufficiently long during imprinting to cause generation of a message.) The message circuit of the present invention could, likewise, be provided with logic to detect combinations of simultaneous switch closings as discussed in section 2 above regarding the switch mechanism.

The mask ROM 640 sound data is typically ADPCM (adaptive differential pulse code modulation) encoded, but other conventional A/D (analog/digital) encoding techniques may be used. The audio ROM chip circuit 620 works in conjunction with a free-running oscillator 610 to decode and output, on lead 618, a sequence of audio signals, the digital representation of which have been stored the mask ROM 640. The oscillator 610 is well-known in the art, and is typically a ceramic type oscillator which typically generates a frequency in the range of 400 kilohertz to 1 megahertz. The oscillator is connected to the voice ROM chip 620. Mask ROM 640 and oscillator 610 may be either a part of, or separate from, the voice ROM circuit 620. The control logic section 631 of audio ROM circuit 620 detects actuation of an activation switch 320(*a,b,c*, or *d*) via operative connections thereto and signals the address generator section 632 to provide the appropriate beginning and ending address locations of the respective stored sound data segment of the mask ROM 640. Compressed digital sound data of the appropriate sound segment is passed from mask ROM 640 to decoder section 633 and output buffer 634 through which it is transformed and converted into an analog type form of sound data. The audio signals output from the voice ROM chip 620 pass through an audio amplifier 630 and are applied to speaker 342 via a first speaker lead 343, so as to be made audible. The speaker 342 also has a second lead 347 which is connected to V+ lead 345 of the battery 344. In FIGS. 3(A) and 5 speaker 342 is shown in the preferred embodiment mounted in housing 300 at the opposite end from the attachment location of die mount unit 360. Speaker 342 is protected by perforated speaker cover 301.

The audio ROM chip or "voice ROM chip" of the preferred embodiment of the invention is typically a specialized and simplified version of a micro-controller apparatus designed to detect one or more of a variety of input actuation signals (often called "triggers"), to look-up a corresponding digital sound message segment associated with said detected "trigger" which is stored (typically in a compressed form, such as ADPCM) in ROM memory (typically within the same integrated circuit as the micro-controller device), to perform required transformations and manipulations of said message information (for example, reconstructing from the ADPCM encoded digital data to digital audio sound for output), and to output an analog type sound signal therefrom. Other functions are often available in such audio ROM devices, such as, chaining several sound segments together to play-out together upon receiving a trigger signal, or playing out a random sound segment upon receiving a trigger signal (this is often done with Christmas music), or detection of combinations of simultaneous switch closures (as discussed in Section 2, above). The audio ROM chip circuit 620 is typically a MOSEL MSS0301 integrated circuit, which comprises mask ROM containing segmented digital representations of the audio special effects messages, an internal oscillator and a multiplicity of external "trigger" inputs which correspond to the playing of respective sound segments. The MOSEL circuit is available from MOSEL-Vitalic, 3910 N. First St., San Jose, Calif. 95134-1501. Other sound effects which may be stored in mask ROM based message circuit 620 include music, such as that stored in a Nippon Precision Circuits NPC M1130 mask ROM which provides for several minutes of simultaneous dual-note music, for example, Christmas carols. Another voice ROM chip circuit having the direct hardware addressability of multiple sound segments which could be utilized within the teachings of the present invention is the OKI MSM6373, available from Oki Semiconductor, 785 N. Mary Avenue, Sunnyvale, Calif. 94086. In order to conserve power, space and/or manufacturing costs, the micro-controller, memory and oscillator are typically manufactured in an integrated "chip-on-board" fashion, and a simple one transistor amplifier 630 is normally used. Of course, a micro-controller device with a general instruction set, such as the 80C31 8 bit micro-controller, could be utilized under the teachings of the present invention. This device is available from many sources: Signetics, Phillips Harris and Intel. The audio amplifier may be a single chip audio amplifier, such as the well known 386, or a simple transistor device 630, of FIG. 6.

It is to be expressly understood that the actual circuitry 340 utilized under the teachings of the present invention could be designed using different circuit components and schematics. For example, different techniques for sound generation could be utilized under the teachings of the present invention, such as, for example, sound effects circuits based on digital or analog sound synthesis or sound generators, mixers and envelop generators, LPC speech synthesis circuits, or allophonic speech generator circuit. A simple variable frequency oscillator, analog or digital, for example, could be used to create a whistle sound when a rubber stamp with an interchangeable image of a train engine mounted thereon is imprinted. Different memory technologies could also be used, including those, such as battery backed RAM, EEPROM and Flash memory which would allow for the Message Circuit to be programmable with regards to the messages stored therein.

It is expressly understood that many different techniques for digitizing, storing and regenerating original, real-life sound are appropriate for use within the present invention. The methods by which, and the criteria for which, speech data, sound effects data, music data, and visual data are stored and regenerated are very extensive. It is not the intention here to give an exhaustive presentation of application of such methods or criteria to the present invention. Many methods and technologies are available for storing and generating audio and/or visual messages in response to the creation of imprints of graphic images and it is assumed that those skilled in the art will employ a variety of said methods under the teachings of the present invention.

Figure 7A:
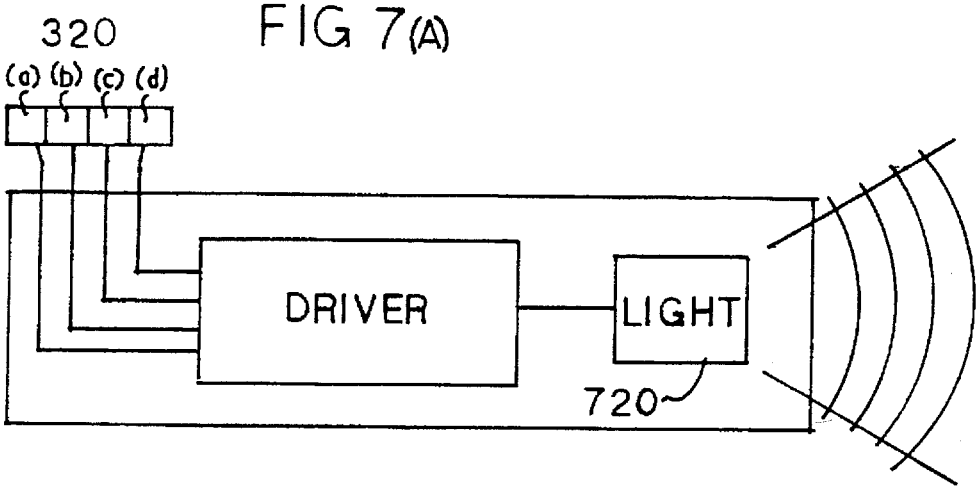
FIGS. 7(A) and 7(B) show in block diagram form, two alternative embodiments of the rubber stamp device.
Figure 7B:
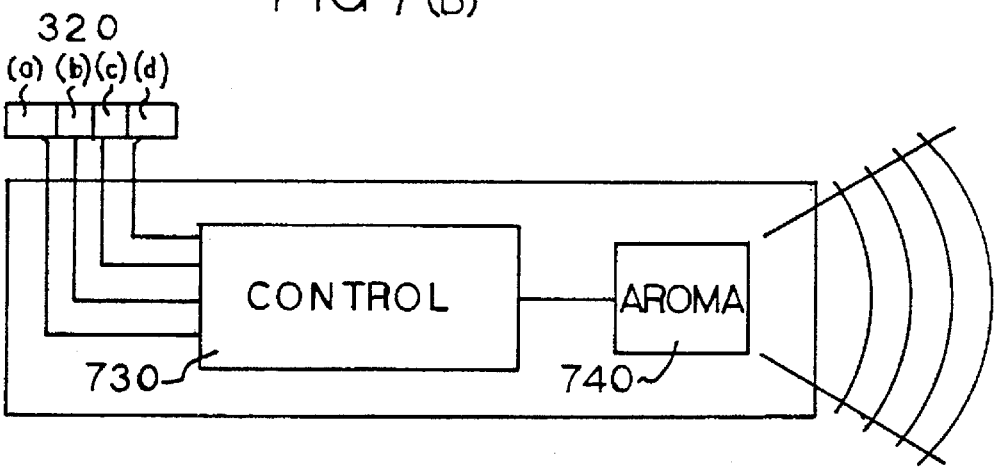

FIGS. 7(A) and 7(B) show alternative embodiments of the rubber stamp device of the present invention. In a first alternative embodiment, a driver 710, responsive to the pressure-sensitive activation switches 320(*a,b,c,d*), actuates a visual display 720, such as a liquid crystal display "LCD" showing visual or textual messages. Upon imprinting, an "LCD" of the alternate embodiment of FIG. 7(A) could, for example, reveal the animal name respectively related to the animal image interchangeably mounted upon the rubber stamp device of the invention. For example, when a tiger image is mounted, the "LCD" displays the word "TIGER" upon imprinting and when an elephant image is mounted the "LCD" displays "ELEPHANT", and so forth. It is to be expressly understood that in the first alternative embodiment of the present invention data stored within the message circuit would be of a textual or graphic type in addition to or in place of sound data. Additionally, it is understood that signals are required to control the display of such data. Such storage and display of visual data is well known in the art and it is expected that those skilled in the art will employ many alternative techniques under the teachings of the present invention. The visual display 720 could also be comprised of light-emitting diodes ("LED"s) or one or more conventional incandescent light sources, representing, for example, to a pair of "eyes" corresponding to the eyes of an animal image imprinted by the rubber stamp device 100. In a second alternative embodiment of FIG. 7(B), a control unit 730, responsive to the pressure-sensitive switches 320(*a,b,c,d*), respectively actuates aroma-releasing element 740. The aroma-releasing element 740 can be a pressurized aroma-containing substance, or normally closed chambers containing aromatic substances which are released into the air via reversibly opening gateways, or thermally activated aromatic chemicals, or the like, actuated upon imprinting. The aromatic message is related to the visual image, for example, the interchangeable images of the stamp device of the invention could be different flowers with the aromatic messages being the scents of these flowers. In the two alternative embodiments it is to be expressly understood that some signals from the message circuit are of a control nature.

Furthermore, a reversibly opening chamber containing an aromatic compound could be operated via a physical mechanism actuated through the reversible translation of the die mount unit upon imprinting, an electronic circuit, thereby, being unnecessary. Additionally, a small bellows mechanism could be provided within the housing of the device of the invention operating with the action of the reversible translating mount unit, an alternative also not requiring an electronic circuit. Such a bellows device could contain aromatic compounds which are expelled into the air when the bellows is operated during imprinting.

The message circuit of the present invention and alternative embodiments thereto, are not to be limited by the actual circuit designs of FIG. 6. The message circuit function comprises transmitting a message, or messages in response to the transference of an image, or images, from the interchangeably mounted image of the rubber stamp device to the medium and insuring that a predetermined message or messages correspond to said imprinted image or images, and additionally transmitting a message or messages in response to a switch operable asynchronously from the imprinting action of the stamp device of the invention.

I claim:

1. An image transfer device capable of generating imprinted reproductions of an image to a target object comprising:

a plurality of interchangeably attachable die mounts each die mount of said plurality of die mounts having a formed interior region, attachment area and mount surface;

means affixed to said mount surface for transferring a said reproduction of an image to said target object upon contact with said target object;

a housing having a formed interior region and attachment area, said attachment area of said housing being attachable to said attachment area of a said die mount;

means, disposed substantially within said formed interior of said housing and a said die mount attached to said housing, responsive to contact between said transferring means of said die mount and said target object, for generating a desired one of a plurality of non-imprinted messages in response to said transfer of said image to said target object, said desired one non-imprinted message specifically associated with said imprinted image, said responsive means comprised of a plurality of independently operable pressure-sensitive switches, a respective switch of said plurality of switches being individually actuated by a respective said die mount attached to said housing responsive to said contact, said attached die mount having an actuator element disposed thereon, means mounting said actuator element so that it can be positioned to actuate any desired one of said plurality of independently operable pressure sensitive switches, said actuator element of said respective attached die mount actuating a said respective independently operable switch responsive to said contact and means provided, in said responsive means, requiring said contact be effected with a predetermined amount of force;

means in said generating means and in said formed interior of said housing for storing a plurality of said non-imprinted messages.

2. The device of claim 1, wherein said image transferring means is an ink stamp.

3. The image transfer device of claim 1, wherein said die mount attached to said housing is translatable with respect to said housing responsive to said contact.

4. The device of claim 1, wherein said at least one non-imprinted message is generated at a time substantially occurring to when said contact is effected.

5. The image transfer device of claim 1, further comprising means disposed substantially upon said housing for triggering said generating means to generate at least one non-imprinted message asynchronously with respect to said transfer of said at least one image to said target object.

6. The image transfer device of claim 1, wherein said each said die mount is formed from plastic.

7. The image transfer device of claim 1, wherein said housing is formed of plastic.

8. The device of claim 1, wherein said each respective independently operable switch comprises a pair of contact elements and a bridge element, said bridge element providing an electrically conductive path between said contact elements when said contact with said target object is effected.

9. The device of claim 1, wherein said generating means comprises means for providing a visual indication.

10. The device of claim 1, wherein said generating means comprises one or more light emitting elements.

11. The device of claim 1, wherein said generating means comprises means for producing an audible sound corresponding to said message.

12. The device of claim 1, wherein said at least one non-imprinted message comprises a sound.

13. The device of claim 1, wherein at least one non-imprinted message comprises an aroma.

14. The image transfer device of claim 1, further comprising means connected to said generating means for selectively inhibiting the operation of said generating means.

15. A device for transferring a visual image to a surface of a target object, said device comprising:

a plurality of interchangeably attachable die mounts each die mount of said plurality of die mounts having a formed interior region, attachment area and mount surface;

means affixed to the mount surface of said each die mount for transferring a visual image to said target object responsive to contact with said target object;

a housing having a formed interior region and attachment area, said attachment area of said housing being attachable to said attachment area of a said die mount;

means, disposed substantially within said formed interior of said housing and a said die mount attached to said housing, responsive to contact between said transferring means and said target object, for generating a desired audible message of a plurality of audible messages in response to said transfer of said image to said target object, said desired audible message specifically associated with said visual image, said responsive means comprised of a plurality of independently operable pressure-sensitive switches, a respective switch of said plurality of switches being individually actuated by a respective said die mount attached to said housing responsive to said contact, said attached die mount having an actuator element disposed thereon, means mounting said actuator element so that it can be positioned to actuate any desired one of said plurality of independently operable pressure sensitive switches, said actuator element of said respective attached die mount actuating a said respective independently operable switch responsive to said contact and means provided, in said responsive means, requiring said contact be effected with a predetermined amount of force;

means in said generating means and in said formed interior of said housing for storing one or more said audible messages in digital form.

16. The device of claim 15, wherein said at least one audible message is produced at a time substantially occurring to when said contact is effected.

17. The image transfer device of claim 15, wherein said die mount attached to said housing is translatable with respect to said housing responsive to said contact.

18. The device of claim 15, further comprising a switch disposed upon said housing permitting manual triggering of said generating means to generate at least one audible message asynchronously with respect to said transfer of said visual image to said target object.

19. The device of claim 15, further comprising: means, responsive to said generating means, for producing at least one visual message.

20. The device of claim 15, wherein said each respective independently operable switch comprises a pair of contact elements and a bridge element, said bridge element providing an electrically conductive path between said contact elements when said contact with said target object is effected.

21. The image transfer device of claim 15, wherein said housing and said plurality of die mounts are formed from plastic.

22. The apparatus of claim 15 further comprising means connected to said generating means for selectively inhibiting the operation of said generating means.

23. A rubber stamp, said rubber stamp having a plurality of reverse images interchangeable thereon for selective transference of each image of a plurality of images corresponding to each reverse image of said plurality of reverse images to an object upon contact with said object, said rubber stamp comprising:

a plurality of interchangeable die mounts each die mount of said plurality of die mounts having an attachment area and mount surface, said each die mount of said plurality of die mounts having a rubber stamp die on the mount surface thereof carrying a said reverse image, a housing having a formed interior region and attachment area, said attachment area of said housing being attachable to said attachment area of a said die mount;

means on said rubber stamp device for generating a desired one of a plurality of special effects, said desired special effect being specifically associated with at least one said image, said housing having a formed interior region containing said generating means, said generating means comprised of a plurality of independently operable pressure-sensitive switches, a respective switch of said plurality of switches being individually actuated by a respective said die mount attached to said housing responsive to said contact, said attached die mount having an actuator element disposed thereon, means mounting said actuator element so that it is positioned to actuate a desired one of said plurality of independently operable pressure sensitive switches, said actuator element of said respective attached die mount actuating a said respective independently operable switch responsive to said contact and means provided, in said responsive means, requiring said contact be effected with a predetermined amount of force, and;

means in said generating means and in said formed interior for storing said plurality of special effects.

24. The rubber stamp of claim 23, wherein said housing is formed from plastic and said plurality of die mounts are formed from plastic.

25. The rubber stamp of claim 23 further comprising means responsive to said image transference for activating said generating means.

26. The rubber stamp of claim 23 wherein said at least one special effect is sound.

27. The rubber stamp of claim 23 wherein said at least one special effect is light.

28. The rubber stamp of claim 23 wherein said at least one special effect is aroma.

29. The rubber stamp of claim 23 further comprising means connected to said generating means for selectively deactivating said generating means.

30. A rubber stamp device, said rubber stamp device having a plurality of reverse images attachable thereon for transference of an image corresponding to a reverse image of a said attached reverse image to an object, said rubber stamp comprising:

a plurality of rubber stamp die carrying said reverse images, a plurality of die mounts each said die mount carrying a said rubber stamp die on a mount surface thereof, each said die mount having an attachment area thereon, means on said rubber stamp for generating a desired one of a plurality of special effects, said desired one special effect being specifically associated with a said image of said attached reverse image, said generating means comprised of a plurality of independently operable pressure-sensitive switches, a respective switch of said plurality of switches being individually actuated by a respective said die mount attached to said housing responsive to said contact, said attached die mount having an actuator element disposed thereon, means mounting said actuator element so that it is positioned to actuate a desired one of said plurality of independently operable pressure sensitive switches, said actuator element of said respective attached die mount actuating a said respective independently operable switch responsive to said contact and means provided, in said responsive means, requiring said contact be effected with a predetermined amount of force, a housing having a formed interior region substantially containing said generating means and an attachment area being attachable to a said die mount, means in said generating means and in said formed interior for storing said plurality of special effects.

31. A rubber stamp device, said rubber stamp device having a plurality of reverse images interchangeably affixable thereto for transference of an image corresponding to a reverse image of said plurality of reverse images to an object, said rubber stamp comprising:

a plurality of rubber stamp die each said die carrying a said reverse image, means on said rubber stamp device for generating a desired one of a plurality of special effects, said desired one special effect being specifically associated with a said image, a housing having a formed interior region substantially containing said generating means and having an attachment being attachable with a said interchangeable reverse image, means in said generating means and in said formed interior for storing said plurality of special effects, and means connected to said generating means for activating said generating means, said activating means comprised of a plurality of independently operable pressure-sensitive switches, a respective switch of said plurality switches being individually actuated by a respective said die mount attached to said housing respective to said contact, said attached die mount having an actuator element disposed thereon, means mounting said actuator element so that it is positioned to actuate a desired one of said plurality of independently operable pressure sensitive switches, said actuator element of said respective attached die mount actuating a said respective independently operable switch responsive to said contact and means provided, in said responsive means, requiring said contact be effected with a predetermined amount of force.

* * * * *